US008646425B2

(12) United States Patent
Methley et al.

(10) Patent No.: US 8,646,425 B2
(45) Date of Patent: Feb. 11, 2014

(54) VALVE MECHANISM FOR AN INTERNAL COMBUSTION ENGINE

(75) Inventors: Ian Methley, Witney (GB); Nicholas James Lawrence, Petersfield (GB)

(73) Assignee: Mechadyne PLC (GB)

( * ) Notice: Subject to any disclaimer, the term of this patent is extended or adjusted under 35 U.S.C. 154(b) by 0 days.

(21) Appl. No.: 13/582,244

(22) PCT Filed: Jan. 28, 2011

(86) PCT No.: PCT/IB2011/050391

§ 371 (c)(1), (2), (4) Date: Dec. 4, 2012

(87) PCT Pub. No.: WO2011/107891

PCT Pub. Date: Sep. 9, 2011

(65) Prior Publication Data

US 2013/0098319 A1 Apr. 25, 2013

(30) Foreign Application Priority Data

Mar. 1, 2010 (GB) ..... 1003389.2

(51) Int. Cl.
*F01L 1/26* (2006.01)

(52) U.S. Cl.
USPC ..... 123/90.22; 123/90.12; 123/90.16

(58) Field of Classification Search
USPC ..... 123/90.22, 320, 321, 90.12, 90.16, 123/90.15, 90.44
See application file for complete search history.

(56) References Cited

U.S. PATENT DOCUMENTS

| | | | | |
|---|---|---|---|---|
| 8,210,144 | B2 * | 7/2012 | Langewisch | 123/90.22 |
| 2011/0220062 | A1 * | 9/2011 | Sailer et al. | 123/321 |
| 2012/0024260 | A1 * | 2/2012 | Groth et al. | 123/321 |
| 2012/0132162 | A1 * | 5/2012 | Yoon et al. | 123/90.16 |

* cited by examiner

*Primary Examiner* — Thomas Denion
*Assistant Examiner* — Daniel Bernstein
(74) *Attorney, Agent, or Firm* — Gigette M. Bejin

(57) ABSTRACT

A valve mechanism is disclosed for a cylinder of an internal combustion engine which comprises two gas exchange poppet valves mounted in a cylinder head, a bridge 122 acting on the two valves, a cam for actuating the two valves, a slider 124 movable by the cam and slidable relative to the bridge 122, and a hydraulically controlled locking system having a latched position in which the slider transmits the force of the cam to the bridge 122 to actuate the two valves and a released position in which the valves are deactivated and the slider slides freely relative to the bridge. In the invention, the slider 124 is urged towards the cam by a spring 134 acting between the slider 124 and the cylinder head.

9 Claims, 2 Drawing Sheets

VALVE MECHANISM FOR AN INTERNAL COMBUSTION ENGINE

RELATED APPLICATIONS

This patent application claims priority to PCT application number PCT/IB2011/050391, filed on Jan. 28, 2011.

FIELD OF THE INVENTION

The present invention relates to a valve mechanism for a cylinder of an internal combustion engine, comprising two gas exchange poppet valves mounted in a cylinder head, a bridge acting on the two valves, a cam for actuating the two valves, a slider movable by the cam and slidable relative to the bridge, and a hydraulically controlled locking system having a latched position in which the slider transmits the force of the cam to the bridge to actuate the two valves and a released position in which the valves are deactivated and the slider slides freely relative to the bridge.

BACKGROUND OF THE INVENTION

A valve mechanism as set out above is known from JP-2004360485. In this prior art reference, a post with an oil passageway projects from the cylinder head. A bridge assembly straddling the stems of the two poppet valves includes a cylinder housing. The post which projects from the cylinder head passes through a hole in the lower end of the cylinder and guides the bridge assembly to slide parallel to the post and to the valve stems. An annular piston, which serves the purpose of the slider mentioned above, is disposed within the cylinder and is moved by the cam that operates the two valves. The outer wall of the piston seals against and slides relative to the inner wall of the cylinder and its inner wall seals against and slides relative to the outer wall of the post. A working chamber is defined within the piston that receives hydraulic fluid (engine oil) through the passageway in the post. The pressure in the working chamber operates a locking system which selectively locks the piston to the bridge.

In this way, when the piston is locked to the bridge the valves are opened and closed by the cam whereas when the locking system is released, the annular piston moves with the cam but is uncoupled from the bridge so that the valves remain stationary. This allows the valves to be deactivated hydraulically.

To maintain the annular piston in contact with the cam and the bridge in contact with the valve stems, a spring is housed within the cylinder, surrounding the post, to urge the piston and the cylinder apart.

The present invention recognises certain problems with such a construction. In order to be able to push the piston against the cam and prevent the bridge from lifting off the poppet valves the spring needs to be fairly substantial. A first problem in meeting this requirement is that of space. The maximum dimensions of the cylinder in the bridge assembly are determined by the limited space between the poppet valves and it is difficult to provide enough space in the cylinder to accommodate a spring of the size required. Furthermore, if a large spring is used and the bridge assembly is somehow enlarged to accommodate it, then this results in a significant increase in the inertial mass of the bridge assembly and larger valve springs are then required to cope with this increased mass that the valves have to lift as they close.

SUMMARY OF THE INVENTION

With a view to mitigating the foregoing disadvantages, the present invention provides a valve mechanism for a cylinder of an internal combustion engine, comprising two gas exchange poppet valves mounted in a cylinder head, a bridge acting on the two valves, a cam for actuating the two valves, a slider movable by the cam and slidable relative to the bridge, and a hydraulically controlled locking system having a latched position in which the slider transmits the force of the cam to the bridge to actuate the two valves and a released position in which the valves are deactivated and the slider slides freely relative to the bridge, wherein the slider is urged towards the cam by a spring acting between the slider and the cylinder head.

Preferably the slider is supported by the cylinder head for movement towards and away from the cam.

A further problem encountered by JP-2004360485 is that a pressure relief is required to limit the pressure in the working chamber and during normal operation the volume of the working chamber is constantly changing and work is done to pump oil in any out of the working chamber.

In a preferred embodiment of the present invention, the support in the cylinder head for the slider includes an oil passageway for pressurising the locking mechanism which is only open when the slider is aligned with the base circle of the cam. Thus the state of the locking system can only be changed during minimum valve lift but the volume of the working chamber remains constant during the reciprocation of the slider.

Because the spring in the present invention acts between the cylinder head and the slider, it cannot itself ensure that the bridge remain in contact with the valves at all times. It is therefore convenient for clips to be provided for securing the bridge to the ends of the poppet valves.

It is sometimes desirable to be able to open one of the valves in a pair independently of the other using a separate mechanism. This may be achieved by arranging for the stem of one of the poppet valves to project through a hole in the bridge.

In the latter case, the poppet valve of which the stem projects through the hole in the bridge may preferably be connected to the bridge by a spring biased lost motion coupling.

BRIEF DESCRIPTION OF THE DRAWINGS

The invention will now be described further, by way of example, with reference to the accompanying drawings, in which.

DETAILED DESCRIPTION OF THE PREFERRED EMBODIMENT(S)

Figure 1:
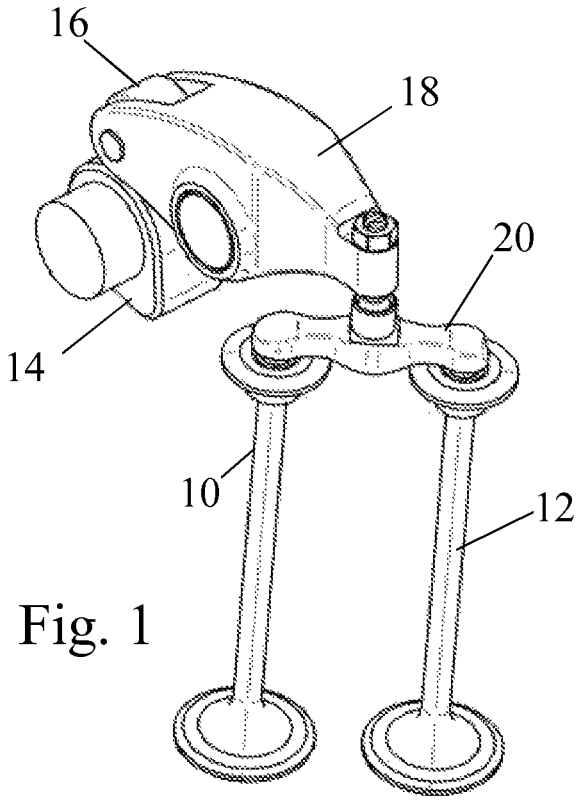
FIG. 1 shows a conventional valve mechanism in which two poppet valves are operated by a common valve through a bridge.

In FIG. 1, two poppet valves 10 and 12 are controlled by a common cam 14. The cam 14 acts on the two valves 10 and 12, by way of a roller cam follower 16, a rocker 18 and a bridge 20. The invention seeks to implement selective deactivation of the valves 10 and 12 by decoupling the bridge 20 from the rocker 18 so that the bridge 20 may remain stationary and the valves 10 and 12 may remain closed as the cam 14 rotates and the end of the rocker 18 continues to move up and down.

Figure 2:
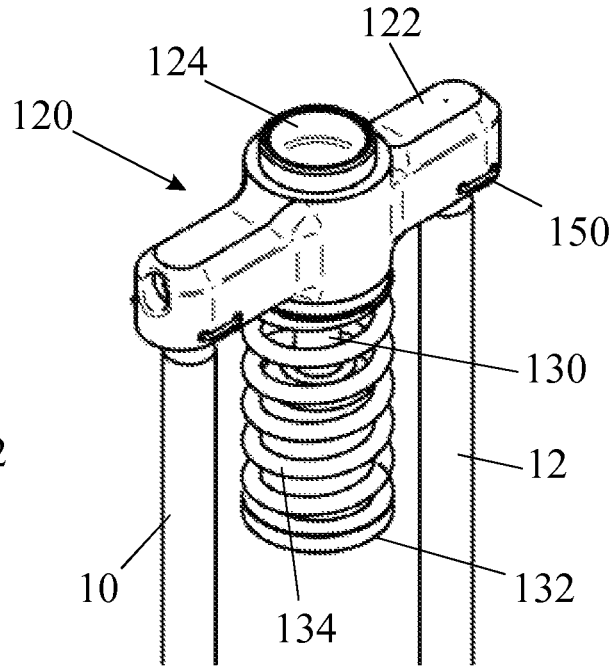
FIG. 2 is a perspective view of valve mechanism of the invention in which the bridge is replaced by a bridge assembly capable of selectively deactivating the two poppet valves.
Figure 3:
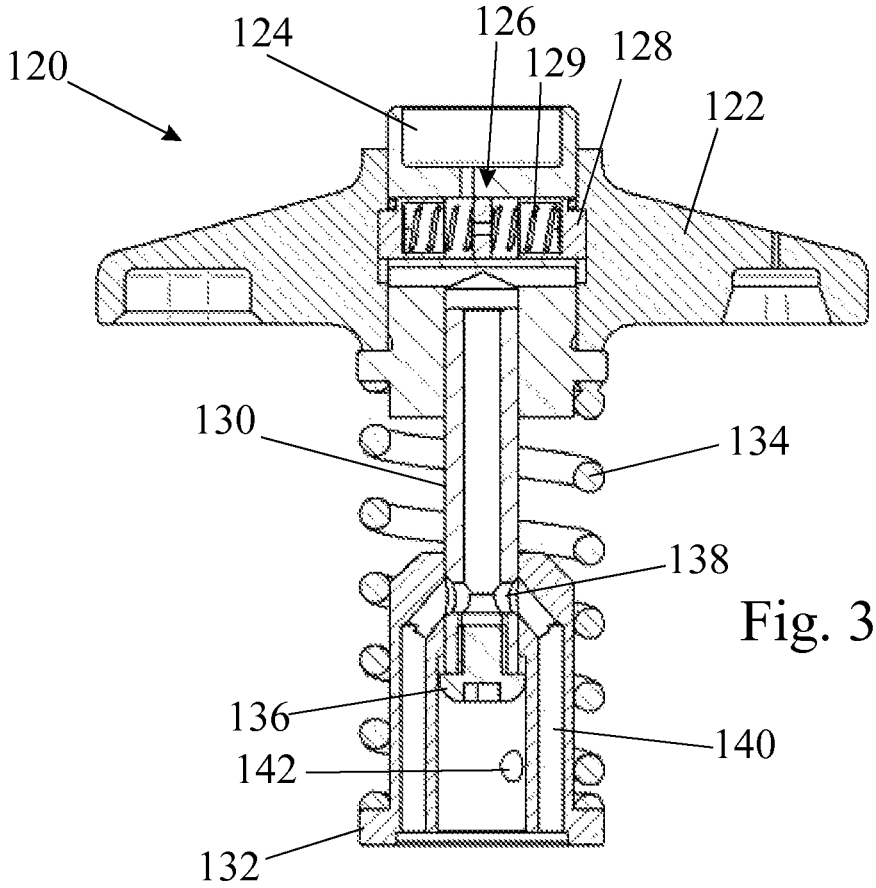
FIG. 3 is a section through the valve mechanism of FIG. 2 in the plane containing the axes of the two poppet valves but with the poppet valves omitted.
Figure 4:
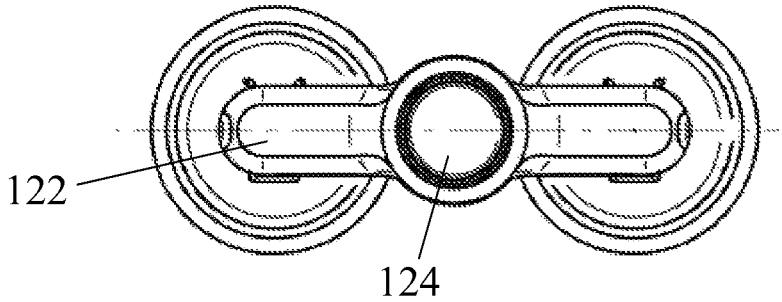
FIG. 4 is a plan view from above of the mechanism in FIGS. 2 and 3.

This is achieved by substituting for the bridge 20 a bridge assembly 120 as shown in FIGS. 2 to 4. The bridge assembly 120 comprises a bridge piece 122 and a cylindrical slider 124 that can slide in a central bore in the bridge piece 122. The slider 124 always moves with the cam 14 and the rocker 18 and the bridge piece 122 remains in contact with the ends of the poppet valves 10 and 12 at all times.

A locking mechanism 126 housed in the bridge piece 122 is used to lock the bridge piece 122 for movement with the slider 124. In a latched position of the locking mechanism 126, the bridge piece and the slider 124 move in unison and the valves are operated in the usual manner, whereas in a released position of the locking mechanism 126 the slider 124 is free to slide relative to the bridge piece 122 so that the valves 10,12 can remain closed as the rocker 18 moves up and down.

Figure 5:
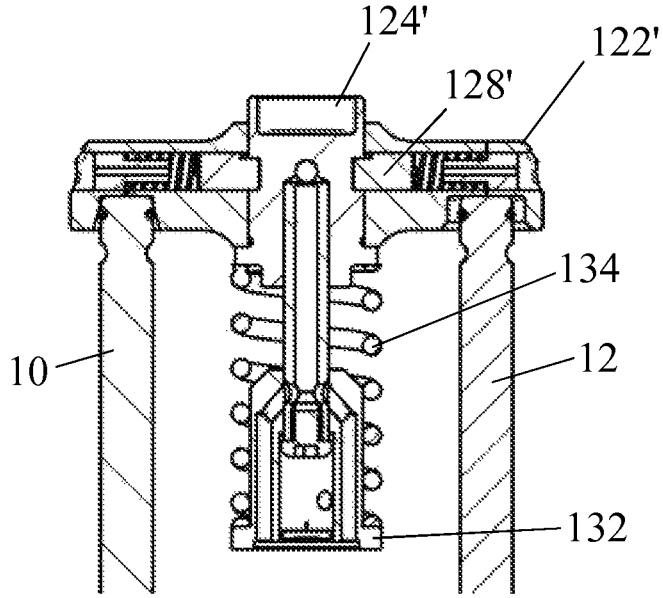
FIG. 5 is a view similar to that of FIG. 3 of any alternative embodiment of the invention.

The locking mechanism in the embodiment of FIG. 3 is formed by two hydraulically operated locking pins 128 mounted in the slider 124 whose ends engage in a groove in the bridge piece 122. Alternatively, as shown in the embodiment of FIG. 5, which in other respects is identical with that of FIG. 3, locking pins 128' can be mounted in the bridge piece 122' to engage in a groove in the slider 124'. The precise nature of the locking mechanism 126 is not of fundamental importance to the present invention and it need not therefore be described herein in greater detail.

Pressure medium is supplied to the locking mechanism 126 to activate and deactivate the valves 10 and 12, by way of a hollow tube 130 that is secured to and moves with the slider 124 and which moves relative to and sealingly engages a hollow pedestal 132. The pedestal 132 is securely located relative to the engine cylinder head and communicates with an oil passageway in the cylinder head. A spring 134 acts to force the pedestal 132 against a locating formation (not shown) in the cylinder head and to push the slider 124 against the rocker 18.

The lower end, as viewed, of the tube 130 is closed off by a blanking screw 136. Near its lower end, the tube 130 has a holes 138 which admit a hydraulic fluid, usually engine oil, into the tube 130 from passages 140 formed in the pedestal 132. Thus oil can be supplied to and discharged from the locking mechanism 126 when the slider 124 is in the position illustrated but as soon as the slider 124 is pushed down by the cam 14, the locking mechanism is hydraulically isolated. The state of the locking mechanism 126 can thus only be changed when the slider is in the illustrated position, that is to say when the cam follower 16 is on the base circle of the cam 14 (minimum lift).

The spring 134 always urges the slider 124 against the rocker 18 but additional steps need to be taken to maintain the bridge piece 122 in contact with the ends of the poppet valves. This is achieved in the embodiments of the FIGS. 2 to 5 by means of clips 150 that pass through holes in the bridge piece 122 into circumferential grooves near the tips of the poppet valves 10, 12.

To set the locking mechanism 126 in the position illustrated in FIG. 3, oil is delivered under pressure to the locking mechanism 126 from the engine via the passages 140, the holes 138 and the tube 130, while the bridge piece is in the position of minimum lift. This requires movement of only a small volume of oil sufficient to move the locking pins 128 from their retracted to their extended positions.

When the roller follower 16 next moves onto the ramp of the cam 14 the downward movement of the slider 124 relative to the pedestal 132 isolates the working chambers of the hydraulic locking mechanism from the passages 140 and the locking mechanism remains in the locked position. The movement of the slider 124 is therefore transmitted to the bridge piece 122 and the valve 10, 12.

Deactivation cannot now take place until the valves are once again fully closed and the cam is in the minimum lift position shown in FIG. 3. If at this time a low pressure is applied to the locking mechanism 126, the pins 128 will be retracted by the springs acting on them, thereby decoupling the slider 124 from the bridge piece 122 and deactivating the valves 10 and 12. The slider 124 will continue to be moved up and down by the rocker 18 but its movement will not be conveyed to the valves 10, 12 and instead it will merely slide freely relative to the bridge piece 122.

The embodiment of FIG. 5 differs slightly from that of FIG. 3 in the manner in which it is controlled. In FIG. 5 high pressure is used to disengage the locking mechanism 126 and the springs acting on the pins 128' bias them into the extended locking position.

The lower of the spring 130 always rest on the cylinder head and it does not form part of the mass of the bridge assembly that moves with the valves. As such, when the locking mechanism is engaged, the valve springs do not have to perform additional work to displace the centre of mass of the spring and on the contrary the spring 134 assists the valve springs in raising the weight of the bridge assembly. There is furthermore nothing to preclude the use of a spring that is comparable in strength and mass with one of the valve springs, thereby ensuring that the slider is at all times urged firmly towards the rocker 18.

Figure 6:
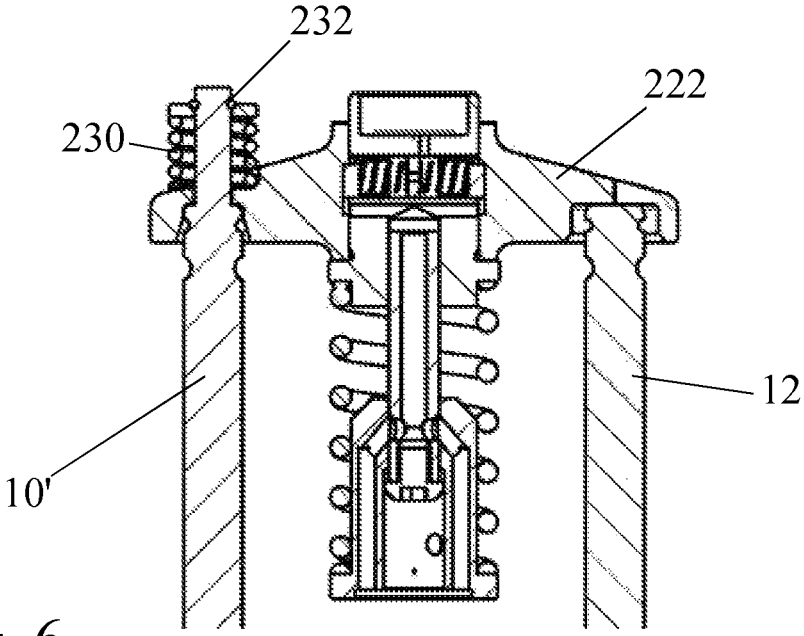
FIG. 6 is a further view similar to that of FIG. 3 showing a still further embodiment of the invention.

There are occasions when it is desired to override the cam operation of one of the two valves and maintain it permanently open by operation of a separate actuator. In the modification shown in FIG. 6, the end of the stem of the valve 10' passes through a hole in the bridge piece 222. The bridge piece acts on a shoulder of the stem such that whenever the bridge piece 222 moves downwards, as viewed, the valve stem must move with it. However, an actuator can act on the upper end of the stem of the valve 10' to move it downwards and open the valve without affecting the bridge piece 222 nor the other valve 12.

This lost motion coupling between the valve and the bridge would, on its own, allow the bridge piece to lift off the valve stem. To prevent such separation from occurring, the bridge piece 222 is urged down against the shoulder on the valve stem by a spring 230 that acts between the bridge piece 222 and a circlip 232 secured to the stem of the valve 10'.

What is claimed is:

1. A valve mechanism for a cylinder of an internal combustion engine, comprising two gas exchange poppet valves (10,12) mounted in a cylinder head, a bridge (122) acting on the two valves, a cam for actuating the two valves, a slider (124) movable by the cam and slidable relative to the bridge (122), and a hydraulically controlled locking system having a latched position in which the slider (124) transmits the force of the cam to the bridge (122) to actuate the two valves (10,12) and a released position in which the valves are deactivated and the slider (124) slides freely relative to the bridge (122), characterised in that the slider (124) is urged towards the cam by a spring (134) acting between the slider and the cylinder head.

2. A valve mechanism as claimed in claim 1, wherein the slider is supported by the cylinder head for movement towards and away from the cam.

3. A valve mechanism as claimed in claim 2, wherein the support in the cylinder head for the slider includes an oil passageway for pressurising the locking mechanism.

4. A valve mechanism as claimed in claim 3, wherein the oil passageway is only open when the slider is aligned with the base circle of the cam.

5. A valve mechanism as claimed in claim 1, wherein clips are provided for securing the bridge to the ends of the poppet valves.

6. A valve mechanism as claimed in claim 1, wherein the stem of one of the poppet valves projects through a hole in the bridge to enable the latter poppet valve to be opened while the other poppet valve remains closed.

7. A valve mechanism as claimed in claim 1, wherein the poppet valve of which the stem projects through the hole in the bridge is connected to the bridge by a spring biased lost motion coupling.

8. A valve mechanism as claimed in claim 1, wherein the locking system comprises locking pins and springs housed in the slider that engage with a slot in the bridge.

9. A valve mechanism as claimed in claim 1, wherein the locking system comprises locking pins and springs housed in the bridge that engage with a slot in the slider.

* * * * *